United States Patent [19]

Taube

[11] Patent Number: 4,742,529

[45] Date of Patent: May 3, 1988

[54] THREE-PHASE ARC FURNACE

[75] Inventor: Thomas H. Taube, Neunkirchen a. Brand, Fed. Rep. of Germany

[73] Assignee: C. Conradty Nurnberg GMBH & Co. KG, Fed. Rep. of Germany

[21] Appl. No.: 4,620

[22] Filed: Jan. 20, 1987

[30] Foreign Application Priority Data

Jan. 23, 1986 [DE] Fed. Rep. of Germany ..... 3601989

[51] Int. Cl.[4] ..... H05B 7/103

[52] U.S. Cl. ..... 373/101

[58] Field of Search ..... 373/101, 94, 99, 100

[56] References Cited

U.S. PATENT DOCUMENTS 3,717,445 2/1973 Yoshimura ..... 373/94

4,653,066 3/1987 Phillips ..... 373/94

4,653,067 3/1987 Koenig et al. ..... 373/101

FOREIGN PATENT DOCUMENTS 80954 6/1983 European Pat. Off. ..... 373/101

*Primary Examiner*—Roy N. Envall, Jr.

*Attorney, Agent, or Firm*—Wolf, Greenfield & Sacks

[57] ABSTRACT

An arc furnace particularly for smelting of steel comprises three electrodes arranged symmetrically on a circle and connected to the phase by contact pads mounted on horizontal carrier arms.

For optimizing the current loading of the contact pads and for minimising reactive losses of the arrangement, the contact pads are arranged centrosymmetrically within the electrode pitch circle.

4 Claims, 2 Drawing Sheets

THREE-PHASE ARC FURNACE

The invention relates to a three-phase arc furnace in particular for smelting, alloying and/or hot holding of steel.

A three-phase electrical arc furnace for smelting of steel is disclosed in German Patent Specification No. 3114145. In this electrical arc furnace, for geometrical reasons the contact pads grip the electrodes at a spacing of at least double the electrode diameter. The contact pads arranged in the electrode clamp normally lie on a circle which is of the same size as the electrode pitch circle and which has its centre displaced along the electrode radius in the direction of the transformer housing. The pitch circle radius in such an arrangement is equal to at least 1.15 times the electrode diameter. When the current feeds to the contact pads are laid in parallel, the spacing of their geometrical centres is twice the electrode diameter.

In this known arc furnace, it is disadvantageous that as a result of the asymmetrical (to the current path) arrangement of the contact pads on the outer contact pads as a result of the proximity effect, current density on the part of the contact pad facing the centrally aarranged electrode is higher than that on the outwardly facing side.

The constructional constraints of this arrangement have furthermore the disadvantage that the long outer carrying arms are susceptible to lateral oscillations which can lead to fracture of the electrodes at the fixing locations on the carrier arm. Furthermore, it has been proven in practice that servicing of the central carrier arm is expensive as a result of its poor accessibility.

It is therefore an object of the invention to provide an arc furnace of the type mentioned in the introduction in which an optimal current loading of the contact pads is ensured and in which by minimising of the mutual spacing of the current feeds the reactance of the whole arrangement is reduced.

This object is achieved according to the invention in that the contact pads are arranged centrosymmetrically within the electrode circle.

In the arrangement according to the invention, thus the contact pads lie on the radii of the electrode pitch circle through the respective axes of the electrodes and lie on the side of the electrodes facing the central point of the elctrode circle. In this connection, naturally the contact surface of each contact pad, with the associated electrode, faces outwardly with reference to the centre of the electrode pitch circle.

In the arc furnace according to the invention, a uniform current loading of the contact pads results. Moreover, the reactive losses are minimised.

As a result of the arrangement according to the invention, it is furthermore ensured that the central carrier arm is the longest which improves accessibility of the electrode frame and its servicability. In addition, the mechanical lateral oscillations of phases 1 and 3 are minimised.

Futhermore, the space requirements for the electordes on the roof are smaller so that more free space is available for a fourth and fifth roof aperture. This opening can be used for extraction and charging of supplementary substances. This arrangement is particularly of advantage for ladle furnaces since by making the electrode pitch circle as small as possible the refractory lining of the ladle furnace can be optimally protected.

The arrangement according to the invention permits the spacing of the contact pads between the individual phases to be equal to or as the case may be smaller than the diameter of the electrodes. The electrode pitch circle is correspondingly reduced and the current loading of the contact pads is made still more uniform.

An advantageous further development of the invention consists in that the high current feeders from the connection flanges of the contact pads are arranged in parallel throughout whereby the mutual spaceing of the feeders is halved as compared with the usual technology. The electrode pitch circle is of course reduced by the same factor.

The pincer-like clamping mechanism for the outer carrier arm which is furthermore provided according to the invention enables in a simple manner optimum holding of the corresponding electrodes in the desired arrangement of the contact pads.

Exemplary embodiments of the arc furnace according to the invention are illustrated schematically in the drawings, in which:

FIG. 1 shows a clamping device for the electrodes, in particular the first and third phases with a contact pad arranged according to the invention.

Figure 1:
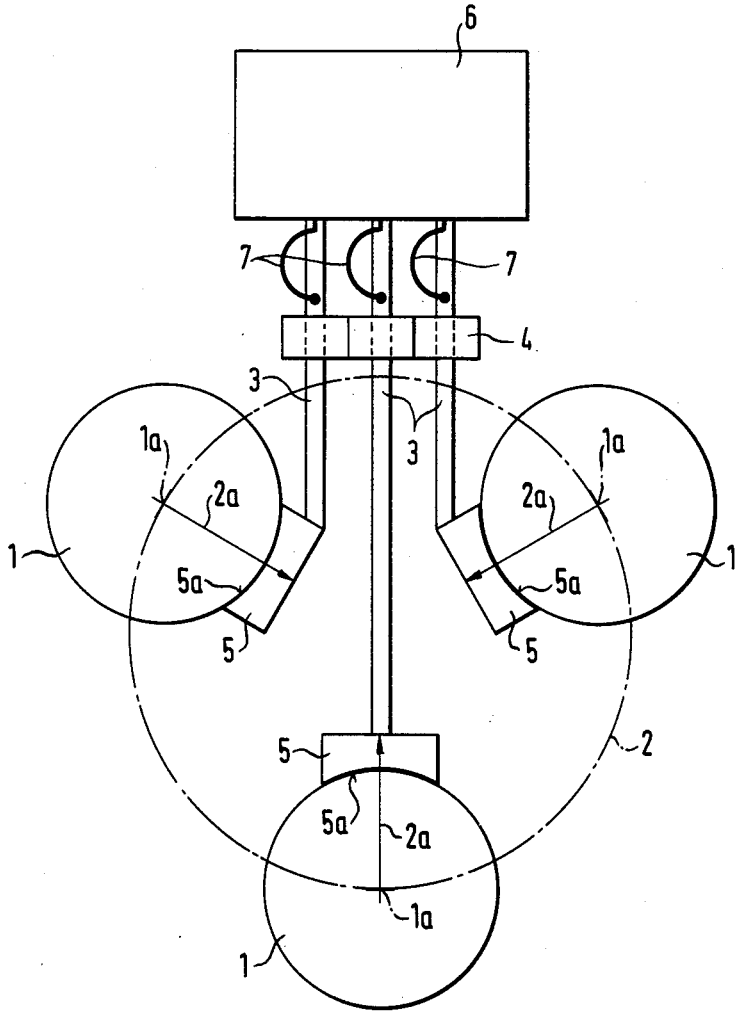
FIG. 1 shows the essential components of an arc furnace according to the invention.

According to FIG. 1 three electrodes of an arc furnace are designated with 1. These are arranged along an electrode pitch circle 2 at the same mutual spacing, i.e. symmetrically. The electrodes 1 are here held in a manner which is not illustrated in detail by means of a clamping device or carrier arms, likewise not illustrated, having current feeders 3 guided horizontally thereon in a mutually parallel arrangement. The electrical connection between the current feeders 3 and the transformer 6 is achieved by means of current cables 7. Vertical adjustment of the electrodes is achieved by means of a jacking device 4. The current loading of the electrodes 1 is achieved by means of respective contact pads 5.

According to the invention, these contact pads 5 are now centrosymmetrically arranged within the electrode pitch circle 2. This means that the respect contact pads 5 lie at the radius 2*a* from the respective axis 1*a* of the corresponding electrode 1. In this connection, the contact surface 5*a* of the respective contact pad 5 with the associated electrode 1 of course faces outwardly with reference to the centre of the electrode pitch circle 2.

Figure 2:
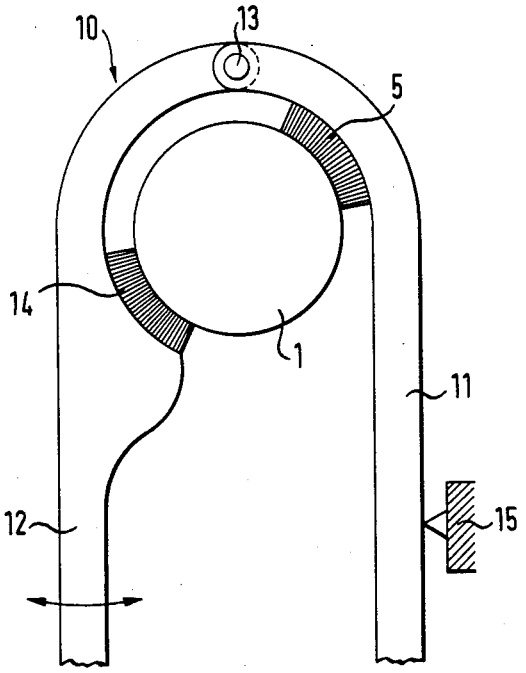

FIG. 2 likewise shows a schematic representation of a first exemplary embodiment of a clamping device for the arrangement according to the invention of the contact pads 5, in particular for phases 1 and 3, i.e. the outermost carrier arms 3. According to FIG. 2, the pincer like clamping device, designated as a whole with 10, consists of a pincer component 11 mounted on a bearing 15, i.e. stationary, and a pincer component 12 movable about the pivot 13. When the clamping device 10 is closed, the electrode 1 is gripped between the pressure jaw 14 and the contact pad 5 arranged on the fixed pincer component 11.

Figure 3:
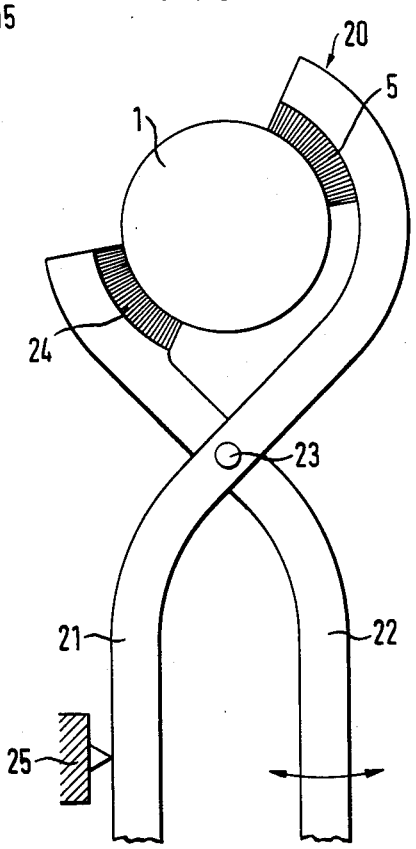
FIG. 3 shows a further exemplary embodiment of a clamping device haivng a contact pad arranged according to the invention.

FIG. 3 shows, likewise in a schematic illustration, a second exemplary embodiment of a pincer like clamping device, also particularly for the two outer carrier arms 3. This clamping device designated as a whole with 20 consists likewise of a fixed pincer component 21 mounted on the bearing 25 and a movable pincer component 22 which is pivotable about a pivot 23 with respect to the fixed pincer component 21. The pressure jaw 24 is arranged on the movable pincer componet 22 whilst the contact pad 5 which lies diametrically opposite in the clamping position is located on the fixed pincer component 21.

What is claimed is:

1. A three-phase electrical arc furnace for smelting of steel, comprising three electrodes symmetrically arranged on a circle for connection to the three phases of a power supply, each of said electrodes being carried by a contact pad, each contact pad being carried by a horizontal carrier arm, said contact pads being arranged centrosymmetrically within said circle.

2. An arc furnace according to claim 1 wherein the spacing of the contact pads from each other is no greater than the diameter of the electrodes.

3. An arc furnace according to claim 1 wherein high current feeders are provided for the contact pads and are guided in parallel throughout by connection flanges of the contact pads on the carrier arms.

4. Arc furnace according to claim 1 wherein the electrodes mounted on the outer carrier arms are held by a pincer-like clamping mechanism including the contact pads.

* * * * *